US005664385A

United States Patent [19]

Koschitzky

[11] Patent Number: 5,664,385

[45] Date of Patent: Sep. 9, 1997

[54] SHINGLE WITH SLOTS AND METHOD OF MAKING SAME

[75] Inventor: Henry Koschitzky, Downsview, Canada

[73] Assignee: IKO Industries Ltd., Toronto, Canada

[21] Appl. No.: 430,085

[22] Filed: Apr. 27, 1995

[51] Int. Cl.[6] ..... E04D 1/12

[52] U.S. Cl. ..... 52/559; 52/314; 52/315; 52/555

[58] Field of Search ..... 52/559, 315, 554, 52/555, 557, 518, 314

[56] References Cited

U.S. PATENT DOCUMENTS

| | | | |
|---|---|---|---|
| 1,843,370 | 2/1932 | Overbury . | |
| 2,199,760 | 5/1940 | Schuetz | 52/559 X |
| 2,347,250 | 4/1944 | Burnett | 52/559 |
| 4,352,837 | 10/1982 | Kopenhaver | 427/198 |
| 5,186,980 | 2/1993 | Koschitzky | 427/187 |
| 5,400,558 | 3/1995 | Hannah et al. | 52/559 |
| 5,426,902 | 6/1995 | Stahl et al. | 52/559 X |

*Primary Examiner*—Michael Safavi
*Attorney, Agent, or Firm*—Bereskin & Parr

[57] ABSTRACT

A roofing shingle having a series of closely adjacent areas of granules, the areas being of differing colors. To achieve a sharp visual demarcation between the adjacent areas, narrow slots are formed in the transition areas between adjacent areas of granules. The slots extend substantially the entire height of the portion of the shingle which will be exposed when the shingle is mounted on a roof. Preferably the headlap area of each shingle is coated with dark colored granules which will show through the slots when the shingles are installed, to accentuate the visual demarcation between adjacent differently colored areas of granules.

5 Claims, 2 Drawing Sheets

SHINGLE WITH SLOTS AND METHOD OF MAKING SAME

FIELD OF THE INVENTION

This invention relates to roofing shingles and methods of making them. More particularly, it relates to roofing shingles in which the color of the surfacing layer changes at demarcation lines, and to methods of making such shingles.

BACKGROUND OF THE INVENTION

Roofing shingles are usually made by taking a continuous base sheet of material (e.g. organic felt, fiberglass mat or the like), saturating the base sheet in a base asphalt, covering it with a coating asphalt, and then embedding granules on the top side of the coated sheet. The granules protect the asphalt from breaking down by oxidation caused by ultraviolet rays. The finished sheet is then cut into lanes and then into desired lengths for shingles.

It is known to provide additional decoration for each shingle by providing a patterned appearance on its exposed surface. Commonly the pattern takes the form of a patch-like appearance, with a sequence of areas of granules of one color separated by areas of granules of a different color. Such an appearance is shown for example in U.S. design Pat. No. D309,027.

When a patch-like decorative appearance is created, it is desirable to have a sharp line of demarcation between the color in one area and the color in an adjacent area. Unfortunately, it is extremely difficult to achieve a sharp line of demarcation. The problem is that the granules which form the exposed surface of the shingle are normally dropped by a blender on a base sheet which is travelling at 500 to 600 feet per minute, or more than 8 feet per second. It is difficult to turn off the flow of granules of one color and to start the flow of granules of another color in a sufficiently short time to produce sharply demarcated edges between the two adjacent colors. For example, if it takes 0.01 seconds to start or stop dispensing granules, during this time the sheet will have travelled about one inch, so the transition between areas of different colors would be about one inch long.

Because of this problem, it has been common practice in the past to create the desired patch-like appearance by coating the entire surface of the base sheet with a first layer of granules, and then applying patches of asphalt and granules as a second layer over the first layer of granules. This has the advantage that the granules applied to the patches of asphalt adhere only to those patches, providing sharp transitions. U.S. Pat. No. 4,352,837 (Kopenhaver) and U.S. Pat. No. 5,186,980 (Koschitzky) both disclose methods of applying patches of asphalt and granules as a second layer to a first uniform layer of granules.

However applying second layers of asphalt and granules to the shingle has disadvantages in terms of increased cost. In addition the extra thickness can result in decreased flexibility of the shingle. Therefore it would be desirable to create the appearance of sharply demarcated areas of granules without the need for applying extra layers of asphalt and granules.

BRIEF SUMMARY OF THE INVENTION

Therefore it is an object of the invention in one aspect to provide a method of producing a shingle comprising:

(a) applying a layer of hot coating asphalt to a base sheet to produce a sheet having a layer of said coating asphalt, said sheet having a lengthwise axis, (b) applying a series of closely adjacent areas of granules over said sheet, each area of granules being adhered by said asphalt, adjacent areas of granules being of differing appearance and being separated from each other by transition areas extending at right angles to said lengthwise axis, (c) and forming narrow slots in said transition areas between adjacent areas of granules, said slots being located between substantially all of said areas of granules and extending substantially the entire height of the portion of the shingle which will be exposed when the shingle is mounted on a roof, said slots providing a sharp visual demarcation between adjacent areas of granules.

In another aspect the invention provides a roofing shingle having a lengthwise axis and comprising: a base sheet having an exposed portion which will be visible when said shingle is mounted on a roof and a headlap portion which will be substantially covered by another shingle, a series of closely adjacent areas of granules extending along the length of said shingle and located on said exposed portion, said areas of granules being of different appearance from each other and being separated by transition areas which extend substantially at right angles to said lengthwise axis, said shingle having narrow slots between substantially all of said areas of granules, said slots being located in said transition areas between adjacent areas of granules and extending substantially the entire height of said exposed portion, said slots providing an accentuated visual demarcation between adjacent areas of granules.

Further objects and advantages of the invention will appear from the following description, taken together with the accompanying drawings.

DETAILED DESCRIPTION OF THE PREFERRED EMBODIMENTS

Figure 1:
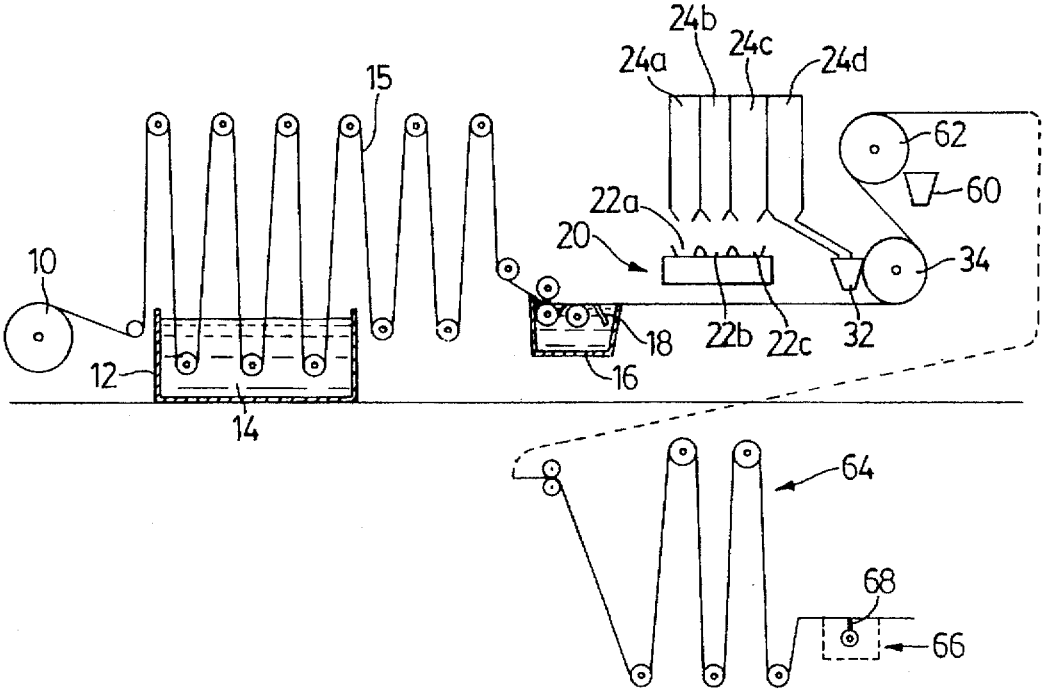
FIG. 1 is a diagrammatic view of a production line for producing roofing shingles according to the invention.

Reference is first made to FIG. 1, which shows a production line for shingles. The production line of FIG. 1 is conventional except as will be noted, and its conventional aspects are therefore only briefly described.

As shown, the FIG. 1 production line includes a roll 10 of organic felt or fiberglass mat. The felt is unrolled and dipped several times into a saturator tank 12 which contains a conventional saturant asphalt 14 at an elevated temperatures such as about 450° F. If a fiberglass mat is used, the mat typically passes over the saturator tank 12 and does not come in contact with the saturant 14. The sheet, indicated at 15, is then passed through a coating tank 16 where it is covered (top and bottom) with a coating asphalt at an elevated temperature such as about 400° F. The coating asphalt is usually mixed with a filler.

The coating asphalt helps to provide the shingle with its water shedding properties. A scraper 18 may be used to remove the excess coating asphalt from the back of sheet 15. The excess is returned to tank 16.

While the asphalt is still hot, the sheet 15 passes beneath a blender 20. The blender 20 contains hoppers 22*a*, 22*b*, 22*c*, each of which is supplied with granules of a different color or blend of colors from those of the other hoppers, from bins 24*a*, 24*b*, 24*c* respectively. While blender 20 is referred to in the trade as a blender, it is simply an on-off control for each of the hoppers.

Figure 2:
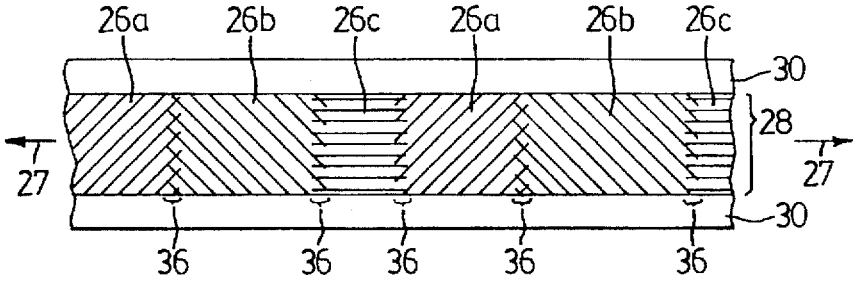
FIG. 2 is a plan view of two lanes of partly formed shingles according to the invention, with a decorative pattern applied to them.

The hoppers 22*a*, 22*b*, 22*c* apply a sequence of closely adjacent different color areas 26*a*, 26*b*, 26*c* to the sheet 15, as shown in FIG. 2. FIG. 2 shows two lanes of the sheet 15 (which sheet is normally many lanes wide). After the production of sheet 15 has been completed, it will be slit lengthwise along lines 27 into individual lanes (whose width is equal to the height of a shingle) and then crosswise into individual shingles. The colored areas 26*a*, 26*b*, 26*c* are normally applied only to the portions 28 of the sheet 15 which will be visible when the shingles made from the sheet are installed on a roof. The colored areas can each vary in length according to computer control. As will be discussed, preferably with the use of the invention the pattern of patches will repeat every shingle or every few shingles (the number of shingles over which the pattern repeats can be selected from one to several). The headlap portions 30 of sheet 15, which areas will normally be covered by another shingle when the shingles are on a roof, need not be covered by expensive colored granules.

After the sheet 15 passes under the blender 20, it travels beneath a spill hopper 32 supplied in part from bin 24*d*. Bin 24*d* typically is partitioned into two parts (not shown). One part contains colored granules which are of the same color composition as the spill which is created from excess colored granules dropped on the sheet, as described below. The second part contains uncolored granules (i.e. granules of natural color, which have not been dyed), which are much less costly than colored granules. Such granules may be naturally dark in color.

The sheet 15 then travels around a slate drum 34, at which time any excess granules which have not adhered to the sheet fall into spill hopper 32*d*. The spill hopper 32*d* is typically partitioned so that the blend of excess colored granules supplied by blender 20 (with any further colored granules needed being supplied from one part of bin 24*d*) falls onto the portion 28 of the sheet, and so that the uncolored (cheaper) granules from the other part of bin 24*d* fall onto the headlap portions 30 (which as mentioned are not normally visible when the shingle is on a roof).

The transverse transition areas between areas of differing color are indicated at 36 in FIG. 2. As shown diagrammatically, these transitions may typically be about four to five inches in width, although this can vary (e.g. they can be smaller if the machine is operated more slowly).

Figure 3:
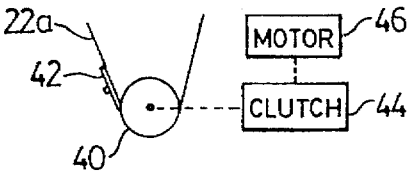
FIG. 3 (PRIOR ART)
FIG. 3 is a diagrammatic view showing a mechanism for dispensing granules from a hopper.

The reason why the transition areas 36 exist is shown with reference to FIGS. 2 and 3. As shown in FIG. 2, each hopper such as hopper 22*a* has at its outlet a fluted roll 40 having a roughened surface, which when rotated carries a layer of granules out of the hopper 22*a* and drops it in a "curtain" across the moving sheet 15 which travels below the hopper. The thickness of the curtain or veil of granules is determined by an adjustable gate 42. The roll 40 is connected by a clutch 44 to a motor 46. The motor 46 runs constantly and the clutch 44 is actuated under computer control (not shown) to rotate roll 40 and hence drop a blend of granules when desired.

Figure 4:
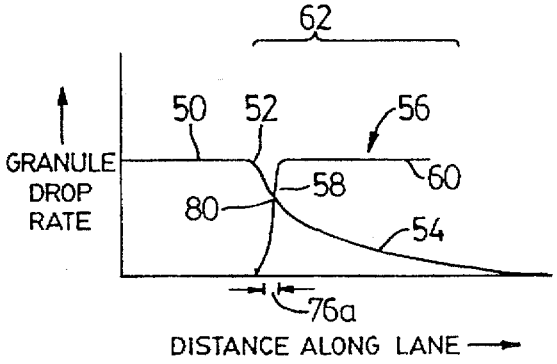
FIG. 4 is a graph showing the distribution of granules with distance along a lane.

Although the clutch 44 is fast acting, the roll 40 cannot as mentioned start and stop instantaneously. Therefore, as shown in FIG. 4, when one roll 40 is turning, it drops a layer of granules as indicted by curve 50 in FIG. 4. When a signal arrives at point 52 to deactuate the clutch 44, the spill rate of granules drops off as indicated by portion 54 of curve 50. When sheet 15 is travelling at 500 to 600 feet per minute, curve portion 54 can be four to five inches long. As shown, curve portion 54 drops steeply at first and then tapers off. The portion of the sheet 15 covered by granules from the first drop during curve portion 54 is not available to be covered by granules from the next drop.

Similarly, when the same point 52 on the lane arrives under the next roll, that next roll is turned on to drop the next blend of colored granules, as indicated by curve 56. Since the roll for the next hopper cannot accelerate instantaneously, curve 56 is not a step function but instead has a rise time indicated by curve portion 58, until it reaches its full discharge rate as indicated by curve portion 60. Rise time 58 is usually quite short, e.g. about 0.5 inch at a sheet speed of 500 feet per minute. The overlap distance on sheet 15 where the spill of granules from one hopper diminishes and that from the next hopper rises is indicated by 62, and forms the transition areas 36 shown in FIG. 2. The lack of a sharp visual dividing line between adjacent different color areas of granules is highly undesirable. The solution achieved by the invention will be described shortly.

After the granules have been applied to the sheet 15, the sheet 15 travels under a hopper 60, where a mineral surfacing agent is conventionally applied to its back surface (from a supply not shown). Excess mineral surfacing agent is removed at drum 62 and is returned to hopper 60.

The sheet 15 then travels through a finish product looper 64 where it accumulates and is allowed to cool. It then enters a cutting section 66 where a conventional cutter 68 cuts the sheets lengthwise along lines 27 into individual lanes or shingle widths, and also cuts the shingles to desired lengths.

Figure 5:
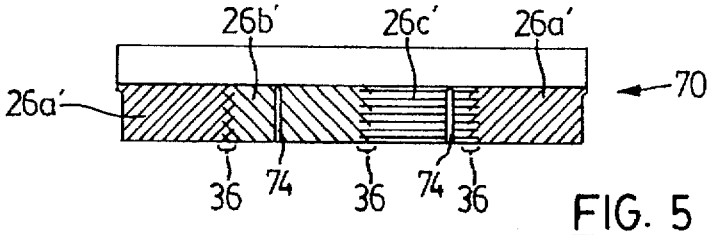
FIG. 5 (PRIOR ART)
FIG. 5 is a top view of a finished shingle produced from a lane like the FIG. 4 lane and having a conventional slot arrangement.

FIG. 5 shows a shingle 70 made from the lanes of FIG. 2. As shown, the shingle 70 has a sequence of colored areas 26*a*', 26*b*', 26*c*', each of different color from its neighbouring areas.

It is normal, when shingles are being cut from sheet 15, to cut slots in shingles, with the slots extending upwardly from the lower edge 72 of the shingle and oriented at right angles to the lengthwise direction of the shingle. Such slots are shown at 74 in FIG. 5. There are normally two (or more) slots 74 between the ends of each shingle (plus half a slot at each end), equally spaced from each other and dividing the shingle into three (or sometimes more) portions, commonly of equal length. The conventional slots 74 are provided primarily for decorative purposes. In the past, the slots have not taken into account the location of the patches, although as shown in U.S. Pat. No. 5,186,980 (Koschitzky), a method is provided of ensuring that double layer patches do not occur at the location of the slots.

Figure 6:
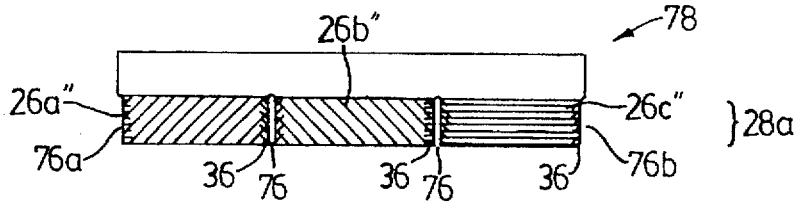
FIG. 6 is a plan view of a shingle like that of FIG. 5 but having a slot arrangement according to the invention.

According to the present invention, slots indicated at 76 (FIG. 6) are located in all or substantially all of the transition areas 36 between adjacent colored areas. As shown for shingle 78 in FIG. 6, the slots 76 extend upwardly over substantially the entire height of the area 28*a* which will be exposed when the shingle is mounted on a roof. The slots 76 provide a sharp visual demarcation between adjacent colored areas and are particularly useful for this purpose when the headlap area 30 of the shingle which underlies them is covered with dark colored granules (black or nearly black), since this provides a vertical dark or shadow line between adjacent patches. The slots 76 are preferably located adjacent the location on the sheet 15 where the second drop begins, as indicated at 76*a* in FIG. 4, i.e. they preferably remove the part of the transition area where the two blends are approximately equal.

Figure 7:
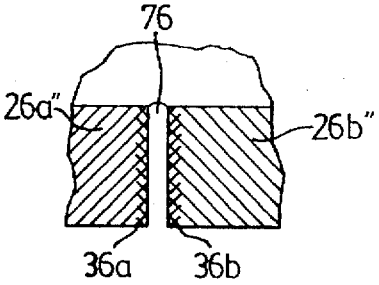
FIG. 7 is an enlarged plan view of a portion of the shingle of FIG. 6.

The reason why slots 76 form a sharp visual demarcation between adjacent colored areas will be apparent from a consideration of FIGS. 4 and 7. Even though the slots 76 may typically be between ¼ and ½ inch in width, and although the transition areas 36 may be several inches in width, nevertheless if a slot 76 is located in a transition area 36 as described, and as indicated in FIGS. 4 and 7, it will remove portions of the transition area 36 where the granules from each blend 26*a*", 26*b*" have approximately a 50:50 ratio (as indicated by point 80 in FIG. 4). Thus for example, the portion 36*a* of the transition area to the left of the left hand slot 76 in FIG. 7 will be predominantly determined by the color of blend 26*a*", while the portion 36*b* of the transition area to the right of the left hand slot 76 will be largely determined by the color of blend 26*b*". The portions 36*a*, 36*b* of the transition area which remain after the slot has been cut will not be noticed by the eye, because of the presence of the slot 76. Typically the slot may be approximately centered about the point 80 where the two adjacent blends have approximately a 50:50 ratio.

In order to form slots 76 in the transition areas between adjacent colored areas, it is necessary to synchronize the cross-cut knives of cross-cut cylinder 42 (which is used to cross-cut the shingles into lengths and also to cut the slots 76) with the locations of the patches. This can be accomplished in various ways. Since normally the position of the slots 76 is determined by the location of the knives on the cross-cut cylinder, and is fixed once a cross-cut cylinder has been installed, the simplest procedure is to synchronize the length of the patches or colored areas with the locations of the slots 76.

Figure 8:
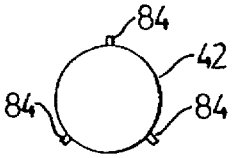
FIG. 8 (PRIOR ART)
FIG. 8 is an end view of a typical cutter used to cut slots in and to cross-cut shingles.
Figure 9:
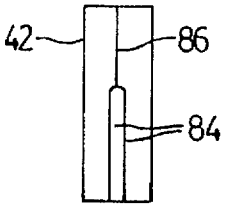
FIG. 9 (PRIOR ART)
FIG. 9 is a plan view of the cutter of FIG. 8.

The cross-cut cylinder 42 (which is conventional) is shown in detail in FIGS. 8 and 9. The cross-cut cylinder 42 may typically have three pairs of knives 84 projecting from its circumference, spaced 120° apart, for forming the slots 76. In addition, from one of the pairs of knives 84 a further knife 86 extends across the width of the cylinder 42, to cross-cut the lane into lengths, i.e. into discrete shingles. If the cylinder 42 is 36 inches in circumference, then it will typically produce 36 inch shingles having two slots 76 between their ends, and half a slot 76*a*, 76*b* at each end, dividing the shingle into three "tabs". (The half slots will form a complete slot when adjacent shingles are laid side by side on a roof.) Of course the configuration of the cylinder 42 may be as desired, and it can for example be of larger circumference to provide a slot pattern (not necessarily uniformly spaced along the length of the shingles) extending and repeating over e.g. two shingles. Alternatively different forms of knives can be used which can provide different slot patterns, to accommodate different patch patterns.

When the pattern of slots 76 has been determined, then the blender hoppers 22*a*, 22*b*, 22*c* are computer controlled to drop colored areas or patches 26*a*, 26*b*, 26*c*, etc. which are of the same length as the distance between respective slots. This can be achieved by simply controlling the timing and duration of operation of each roll 40 of the bins 22*a*, 22*b*, 22*c*.

Once the length of each colored blend drop has been established, the location of the transition areas between adjacent blends 26*a*, 26*b*, 26*c* must be synchronized with the location of the slots 76.

Figure 10:
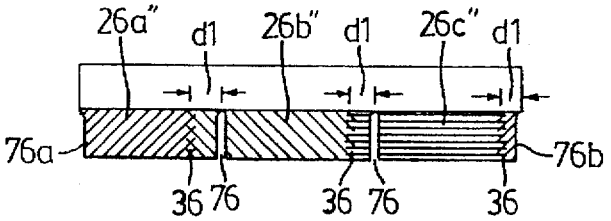
FIG. 10 is a plan view of a shingle like that of FIG. 6 but having misaligned slots.

One method of obtaining the desired synchronization is to observe the moving strip 15 using a video camera and monitor having conventional freeze-frame capability (such as is commonly used to freeze the picture in a "picture-in-picture" in commercial television sets). As indicated in FIG. 10, the "frozen" or still frame will show immediately whether the pattern of cut slots 76 is misaligned with the pattern of transition areas 36 between adjacent colored areas. In FIG. 10 the misalignment is by distance d1. It is assumed that the pattern of colored areas, and hence the pattern of transition areas 36 between the colored areas, is (as mentioned) fixed and is the same for each shingle or repeats over a fixed number of shingles, and that the same pattern is used to control the actuation of the cutter 42 to cut the slots 76. (Although the pattern of colored areas or patches may be fixed, the colors of the granules forming those patches will normally vary, as controlled by the blends of granules dropped from bins 24*a*, 24*b*, 24*c*.)

If a misalignment e.g. by distance d1 occurs, then the length of each shingle can be adjusted slightly to correct the misalignment. Typically the circumference of the cutter cylinder 42 is slightly greater than the length of the shingles to be produced (e.g. the cutter cylinder circumference may be 38 inches for 36 inch shingles), and only 36 inches of sheet 15 are allowed to pass over the cutter cylinder 42 as the cylinder rotates through one revolution. In this way, if more or less of the sheet 15 is permitted to pass over the cutter cylinder 42 as it rotates through one revolution, the length of the shingle can be adjusted. Typically the maximum tolerance for the length of each shingle is 1/16 inch (plus or minus).

Therefore, if the misalignment d1 is one inch, then the length of each shingle can be adjusted (in known fashion, by controlling the speed of the sheet 15 past the cutter cylinder) to lengthen or shorten each shingle by up to 1/16 inch. This will effectively move or "crawl" the sequence of transition areas 36 to the left or to the right by 1/16 inch for each successive shingle, so that after sixteen shingles have been cut, the sequence of transition areas 36 will have been shifted into alignment with slots 76. The shingle length can then be readjusted (by modifying the speed with which the sheet 15 passes over the cutter cylinder) to the correct length, so that the pattern of transition areas 36 ceases "crawling" or shifting with respect to the pattern of slots 76.

Once the pattern of transition areas has been aligned with the slots, any drift in the alignment will be relatively slow and will be shown by the television monitor. Because the transition is relatively slow, adjustments can be made manually if desired. Alternatively, the adjustment can be automatic, using a scanner which will detect the different colors and the transitions between them, and which will also detect the slots 76, to determine whether the slots and the transition areas are in alignment.

Other methods of aligning the slots and the transition areas may also be used.

The slots 76 may vary in width depending on the appearance desired and the sharpness of the transition areas 36. Although the slots will as mentioned normally be between about ¼ and ½ inch wide, they can be as wide as one or two inches if desired, or even more, to provide a suitable decorative appearance for the roof.

Normally the slots 76 will be uniformly spaced, but this is not essential.

Figure 11:
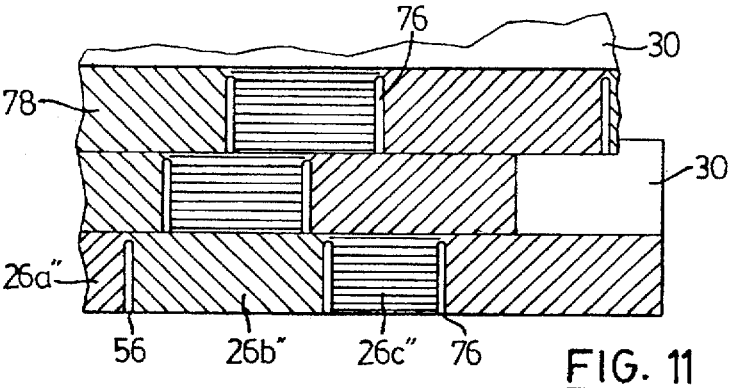
FIG. 11 is a plan view of shingles such as that of FIG. 6 applied to a roof.

FIG. 11 shows a set of shingles such as the shingle 78 of FIG. 4 in place on a roof. When the shingles are mounted on a roof, the headlap area 30 of each shingle is covered by the next higher shingle, and only the slots 76 and the colored areas 26*a*", 26*b*", 26*c*" are visible. As mentioned, even if each slot 76 does not cover the entire width of the transition area between adjacent colored areas, it will still form (particularly from a distance) a sharp visual demarcation between adjacent colored areas. The visual effect will be particularly noticeable when the granules beneath the slots 76 (in the headlap area of the next lower shingle) are of a color which contrasts with the colors of the colored areas 26*a*", 26*b*", 26*c*".

While preferred embodiments of the invention have been described, it will be appreciated that various changes can be made within the spirit of the invention.

I claim:

1. A roofing shingle having a lengthwise axis and comprising; a base sheet having an exposed portion which will be visible when said shingle is mounted on a roof and a headlap portion which will be substantially covered by another shingle, a series of closely adjacent patches of granules extending along the length of said shingle and located on said exposed portion, said patches of granules being of different color from each other and being separated by transition areas which extend substantially at right angles to said lengthwise axis, each transition area thereby being bordered by a patch on each side thereof, the patch on each side of a transition area being a neighboring patch, each transition area containing granules from each of its neighboring patches, each transition area having a first border area adjacent one of its neighboring patches and a second border area adjacent the other of its neighboring patches, said first border area containing a high concentration of granules from said one neighboring patch, and a low concentration of granules from said other neighboring patch, said second border area containing a high concentration of granules from said other neighboring patch and a low concentration of granules from said one neighboring patch, each transition area also containing an intermediate portion between said border areas where granules from both said neighboring patches are present in substantial concentrations, said shingle having narrow slots between substantially all of said patches of granules, said slots being located in said transition areas between adjacent patches of granules and extending substantially the entire height of said exposed portion, said slots extending within said intermediate portions of said transition areas but said transition areas being of greater width than said slots so that there is a portion of a transition area on each side of each slot, said slots thereby providing an accentuated visual demarcation between adjacent patches of granules.

2. A shingle according to claim 1 wherein said headlap portion is covered with granules of dark color, so that when said shingles are mounted on a roof said dark color will be visible through said slots to accentuate the visual transition between adjacent areas of granules.

3. A shingle according to claim 1 wherein said slots are between approximately ¼ and ½ inch in width.

4. A shingle according to claim 1 wherein said slots are uniformly spaced apart along the length of said shingle.

5. A shingle according to claim 1 wherein said shingle has a pair of ends and wherein there is a one-half slot at each end of said shingle.

* * * * *